US012767313B2

(12) United States Patent
Ivansson et al.

(10) Patent No.: US 12,767,313 B2
(45) Date of Patent: Oct. 20, 2026

(54) SET OF PARTS FOR MARINE VESSEL PROPULSION ASSEMBLIES

(71) Applicant: VOLVO PENTA CORPORATION, Gothenburg (SE)

(72) Inventors: Niclas Ivansson, Arboga (SE); Mikael Åsberg, Torslanda (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 651 days.

(21) Appl. No.: 18/048,252

(22) Filed: Oct. 20, 2022

(65) Prior Publication Data

US 2023/0391438 A1 Dec. 7, 2023

(30) Foreign Application Priority Data

Oct. 20, 2021 (EP) ..... 21203676

(51) Int. Cl.
*B63H 23/18* (2006.01)
*B63H 21/14* (2006.01)
(Continued)

(52) U.S. Cl.
CPC ..... *B63H 23/12* (2013.01); *B63H 21/14* (2013.01); *B63H 2023/0258* (2013.01); *B63H 23/18* (2013.01); *B63H 23/30* (2013.01)

(58) Field of Classification Search
CPC ..... B63H 23/12; B63H 21/14; B63H 2023/0258; B63H 23/08; B63H 2021/205;
(Continued)

(56) References Cited

U.S. PATENT DOCUMENTS 2,378,589 A 6/1945 Slack et al.
2,398,174 A 4/1946 Cedillo et al.
(Continued)

FOREIGN PATENT DOCUMENTS

GB 222480 A 1/1925
JP 85116589 A 2/1976
(Continued)

OTHER PUBLICATIONS

Extended European Search Report in corresponding European Application No. 21203676.8 dated Apr. 26, 2022 (9 pages).
(Continued)

*Primary Examiner* — Andrew Polay
(74) *Attorney, Agent, or Firm* — Jeffri A. Kaminski; Venable LLP

(57) ABSTRACT

A set of parts for marine vessel propulsion assemblies is provided A propulsion unit includes a driveshaft, and a first connection module comprising one or more input shafts, wherein the propulsion unit and the first connection module may form at least a portion of a first propulsion assembly. A second connection module comprising one or more input shafts, wherein the propulsion unit and the second connection module may form at least a portion of a second propulsion assembly. The positions, in relation to the propulsion unit, of output shafts of the first and second connection modules, when the first and second connection modules are mounted to the propulsion unit, are the same. The first propulsion assembly may differ from the second propulsion assembly in that the position, in relation to the propulsion unit, of one or more of the one or more input shafts of the first connection module differs from the position, in relation to the propulsion unit, of any of the one or more input shafts of the second connection module.

13 Claims, 10 Drawing Sheets

(51) Int. Cl.
*B63H 23/12* (2006.01)
*B63H 23/02* (2006.01)
*B63H 23/30* (2006.01)

(58) Field of Classification Search
CPC ..... B63H 23/10; B63H 23/18; B63H 23/16; B63H 2005/1256
See application file for complete search history.

(56) References Cited

U.S. PATENT DOCUMENTS

| | | | | |
|---|---|---|---|---|
| 2,708,416 | A | 5/1955 | Schmitter | |
| 4,344,760 | A | 8/1982 | Kulikowski | |
| 4,568,289 | A * | 2/1986 | Heidrich | B63H 23/12 440/75 |
| 10,377,460 | B1 * | 8/2019 | Vining | F16H 1/20 |
| 10,767,708 | B1 * | 9/2020 | Logan | F16D 25/0638 |
| 2012/0129411 | A1 * | 5/2012 | Kodera | B60L 50/16 440/3 |
| 2017/0259897 | A1 * | 9/2017 | Shiraishi | B63H 23/18 |

FOREIGN PATENT DOCUMENTS

| | | | |
|---|---|---|---|
| JP | 4655783 | B2 | 3/2011 |
| RU | 195845 | U1 | 2/2020 |
| WO | 2020083494 | A1 | 4/2020 |

OTHER PUBLICATIONS

European Communication pursuant to Article 94(3) EPC dated Mar. 12, 2025 in corresponding European Patent Application No. 22202650.2, 11 pages.

* cited by examiner

SET OF PARTS FOR MARINE VESSEL PROPULSION ASSEMBLIES

TECHNICAL FIELD

The invention relates to a set of parts for marine vessel propulsion assemblies. The invention also relates to a propulsion assembly for a marine vessel, a method of designing a propulsion system for a marine vessel, and a propulsion assembly for a marine vessel.

The invention is not restricted to any particular type of marine vessel. Instead it may be used on any type and any size of marine vessel, in particular water surface vessels.

BACKGROUND

Propulsion units for marine vessels are known, in which the propulsion unit comprises a driveshaft adapted to be drivingly connected to one or more propellers. It is also known, from WO2020083494A1 that such a propulsion unit may be adapted to receive power from two internal combustion engines. An advantage thereby is that the engine size may be reduced, which allows the use of readily available engines for relatively large power requirements.

U.S. Pat. No. 2,378,589A discloses a ship propulsion system with several engines driving a single propeller shaft.

There is however a desire to provide more flexibility in the vessel installation of propulsion systems, due to power requirements and/or space availabilities differing from one vessel to another.

SUMMARY

An object of the invention is to provide more flexibility in the installation of propulsion systems in marine vessels.

The object is may be reached with a set of parts for marine vessel propulsion assemblies, the set of parts comprising a propulsion unit, wherein the propulsion unit comprises a driveshaft adapted to be drivingly connected to one or more thrust generating devices adapted to generate a thrust by acting on water carrying the marine vessel, wherein the set of parts further comprises a first connection module comprising one or more input shafts, the first connection module comprising an output shaft, wherein the first connection module is adapted to be mounted to a module interface of the propulsion unit, so that the one or more input shafts of the first connection module are drivingly connected to the driveshaft via the output shaft of the first connection module, whereby the propulsion unit and the first connection module form at least a portion of a first propulsion assembly, the set of parts further comprising a second connection module comprising one or more input shafts, the second connection module comprising an output shaft, wherein the second connection module is adapted to be mounted to the module interface of the propulsion unit, so that the one or more input shafts of the second connection module are drivingly connected to the driveshaft via the output shaft of the second connection module, whereby the propulsion unit and the second connection module form at least a portion of a second propulsion assembly, wherein the positions, in relation to the propulsion unit, of the output shafts of the first and second connection modules, when the first and second connection modules are mounted to the propulsion unit, are the same, wherein the first propulsion assembly differs from the second propulsion assembly in that the position, in relation to the propulsion unit, of one or more of the one or more input shafts of the first connection module, for example the angular position thereof, differs from the position, in relation to the propulsion unit, of any of the one or more input shafts of the second connection module, and/or the number of the one or more input shafts of the first connection module differs from the number of the one or more input shafts of the second connection module, and/or the first connection module provides a gear ratio between one or more of the one or more input shafts of the first connection module and the driveshaft, which is different from a gear ratio provided by the second connection module between one or more of the one or more input shafts of the second connection module and the driveshaft.

The propulsion unit may be a pod drive. A pod drive, exemplified below, is herein understood as a propulsion unit which extends through the bottom of the hull, e.g. as opposed through the transom. However, in some embodiments, the propulsion unit may be a stern drive. In some embodiments, the driveshaft could be a propeller shaft, arranged to extend in an angle of e.g. 0-25 degrees to horizontal through a hull of a vessel.

Preferably, the one or more input shafts of the first connection module are each adapted to be connected to a respective output shaft of a respective power supply unit. Preferably, the one or more input shafts of the second connection module are each adapted to be connected to a respective output shaft of a respective power supply unit.

The one or more thrust generating devices may be adapted to be driven by the driveshaft. the driveshaft may be drivingly connected to the one or more thrust generating devices directly or indirectly, e.g. via one or more further shafts. The one or more thrust generating devices may be adapted to be in contact with the water carrying the marine vessel. The one or more thrust generating devices may be adapted to transform the received power into a thrust. The thrust provided by the one or more thrust generating devices may provide a propulsive force to the vessel. The movable part may be rotatable in relation to the stationary part around a rotation axis for adjusting the direction of the thrust in relation to the hull. Thereby, a steering action of the marine vessel may be provided.

The stationary part may be mounted to the hull in an opening in the hull. The stationary part may be flexibly mounted to the hull. For example, one or more sealing rings may be provided between the stationary part and the hull. The sealing rings may extend along a periphery of the opening in the hull through which the stationary part extends. The sealing rings may allow minor movements of the stationary part in relation to the hull. Thereby, the sealing rings may provide a flexible mounting of the stationary part. The sealing rings may also be arranged to seal between the stationary part and the hull. However, in some embodiments, the stationary part may be fixed to the hull, e.g. by bolting or adhesive.

The one or more power supply units may be one or more internal combustion engines and/or one or more electric motors. Thereby, the propulsion unit may be a pod drive, in which a drive shaft extends through the hull to an output transmission outside of the hull, from which output transmission one or more propeller shafts extend to respective propellers. The drive shaft may be mainly perpendicular to a local extension of the hull where the propulsion unit is installed. If the hull is locally horizontal where the propulsion unit is installed, the drive shaft may be mainly vertical. The one or more propeller shafts may be mainly horizontal when the propulsion unit is installed in a vessel.

In some embodiments, the propulsion unit is adapted to receive power from a parallel hybrid drivetrain. Thereby, an electric motor may be arranged between one of, or a respective of, the engines.

The one or more first module input shafts may be adapted to be connected directly or indirectly to the respective power supply unit output shafts.

The first connection module may be selectable for the first propulsion assembly. The second connection module may be selectable for the second propulsion assembly.

As understood, in some embodiments, the first propulsion assembly differs from the second propulsion assembly in that the position, in relation to the propulsion unit, of one or more of the one or more input shafts of the first connection module, differs from the position, in relation to the propulsion unit, of any of the one or more input shafts of the second connection module. The position, in relation to the propulsion unit, of the one or more of the one or more input shafts of the first connection module, which differs from the position, in relation to the propulsion unit, of any of the one or more input shafts of the second connection module, may be the angular position thereof. Thereby, when designing a propulsion system installation in a vessel, the position of the power supply unit in the vessel may be adapted by a suitable selection of the first of the second connection module. In some embodiments, said position may be an absolute position of the one or more of the one or more input shafts.

As also understood, in some embodiments, the first propulsion assembly differs from the second propulsion assembly in that the number of the one or more input shafts of the first connection module differs from the number of the one or more input shafts of the second connection module. Thereby, when designing a propulsion system installation in a vessel, the number of power supply units arranged to drive the propulsion unit may be allowed to differ by a suitable selection of the first or second connection module.

As further understood, in some embodiments, the first propulsion assembly differs from the second propulsion assembly in that the first connection module provides a gear ratio between one or more of the one or more input shafts of the first connection module and the driveshaft, which is different from a gear ratio provided by the second connection module between one or more of the one or more input shafts of the second connection module and the driveshaft. Thereby, when designing a propulsion system installation in a vessel, the propulsion unit may be adapted to power supply units with different output rotational speed ranges.

Thus, the connection modules allow differences between propulsion assemblies, e.g. regarding the angular position of the input shafts, the number of input shafts, or the gear ratios. Thereby a flexibility is provided for the design and installation of marine vessel propulsion systems. This flexibility is allowed with the same propulsion unit interface for all alternative configurations, simply by a selection of a suitable connection module. Thus, the connection modules may be standardized parts of respective module type inventories, for respective different propulsion system configurations. The module type inventories may for example be provided in a storage facility, ready to be used for respective propulsion system configurations.

Embodiments of the invention also allows changing a propulsion system installed in a marine vessel. For example, where an internal combustion engine is replaced by an electric motor, the connection module could be changed to another one providing a different gear ratio adapted to the speed interval of the motor.

The propulsion unit may comprise a housing. The housing may for example enclose an input transmission of the propulsion unit. The first and second connection modules may comprise respective housings.

Preferably, the first and second connection modules being adapted to be mounted to the module interface of the propulsion unit comprises the housing of the first connection module being adapted to be connected to the housing of the propulsion unit by means of one or more first fastening devices, e.g. in the form of or comprising bolts, and the housing of the second connection module being adapted to be connected to the housing of the propulsion unit by means of one or more second fastening devices. Thereby, respective positions, in relation to the propulsion unit, of the first and second fastening devices, when the first and second connection modules are mounted to the propulsion unit, are preferably the same. Thereby, the housings of the first and second connection modules may be adapted to be fastened, e.g. bolted, to the housing of the propulsion unit in identical manners.

The propulsion unit may comprise an input shaft, which could be the driveshaft or a shaft arranged to drive driveshaft, such as an input shaft of an input transmission of the propulsion unit. Thereby, the first and second connection modules being adapted to be mounted to the module interface preferably comprises the output shafts of the first and second connection modules being adapted to be connected to the input shaft of the propulsion unit, for example by means of a bolted flange connection, a spline connection, or a gear connection. Thereby, the modularity of the invention may be embodied by easily mountable modules. In particular, the modules may use the same module fastening devices and/or module engagement devices on the propulsion unit for mounting the housings and output shafts of the modules, to the housing and input shaft of the propulsion unit.

It should be noted that in addition to the first and second connection modules, one or more further connection modules may be adapted to be mounted to the first module interface of the propulsion unit. Each of such further connection modules may form with the propulsion unit a respective further propulsion assembly. Thereby, each further propulsion assembly may differ from the first and second propulsion assemblies by the position, in relation to the propulsion unit, of one or more of one or more input shafts of the further connection module, and/or by the number of the one or more input shafts of the further connection module, and/or by the gear ratio between one or more of the one or more input shafts of the further connection module and the driveshaft.

In some embodiments, the module interface of the propulsion unit is a first module interface, wherein the set of parts further comprises a third connection module comprising one or more input shafts, the third connection module comprising an output shaft, wherein the third connection module is adapted to be mounted to a second module interface of the propulsion unit so that the one or more input shafts of the third connection module are drivingly connected to the driveshaft via the output shaft of the third connection module, whereby the propulsion unit, the first connection module, and the third connection module form at least a portion of the first propulsion assembly.

Preferably, the one or more input shafts of the third connection module are each adapted to be connected to a respective output shaft of a respective power supply unit.

Thereby, a further interface is provided on the propulsion unit. Thereby, one or more further power supply units may be included in the propulsion assemblies allowed by the set of parts. Also, the flexibility provided by the set of parts may be increased, e.g. as exemplified below.

It is understood that the third connection module may form a part of the first propulsion assembly, or of the second propulsion assembly.

The propulsion unit may comprise a second propulsion unit input shaft which is drivingly connected to the driveshaft. The second module interface may comprise an end of the second propulsion unit input shaft. The second module interface may be located oppositely to the first module interface. The first module interface may comprise an end of a first propulsion unit input shaft which is drivingly connected to the driveshaft. The second propulsion unit input shaft may be aligned, i.e. coaxial, with the first propulsion unit input shaft.

In some embodiments, the set of parts further comprises a fourth connection module comprising one or more input shafts, the fourth connection module comprising an output shaft, wherein the fourth connection module is adapted to be mounted to the second module interface of the propulsion unit, so that the one or more input shafts of the fourth connection module are drivingly connected to the driveshaft via the output shaft of the fourth connection module, whereby the propulsion unit, the first connection module and the fourth connection module form at least a portion of a third propulsion assembly, wherein the positions, in relation to the propulsion unit, of the output shafts of the third and fourth connection modules, when the third and fourth connection modules are mounted to the propulsion unit, are the same, wherein the first propulsion assembly differs from the third propulsion assembly in that the position, in relation to the propulsion unit, of one or more of the one or more input shafts of the third connection module, for example the angular position thereof, differs from the position, in relation to the propulsion unit, of any of the one or more input shafts of the fourth connection module, and/or the number of the one or more input shafts of the third connection module differs from the number of the one or more input shafts of the fourth connection module, and/or the third connection module provides a gear ratio between one or more of the one or more input shafts of the third connection module and the driveshaft, which is different from a gear ratio provided by the fourth connection module between one or more of the one or more input shafts of the fourth connection module and the driveshaft.

Preferably, the one or more input shafts of the fourth connection module are each adapted to be connected to a respective output shaft of a respective power supply unit.

The third connection module may be selectable for the first and the second propulsion assemblies. The fourth connection module may be selectable for the third propulsion assembly. It is understood that any of said differences between the first propulsion assembly and the third propulsion assembly may also appear between the second propulsion assembly and the third propulsion assembly.

Similarly to the first and second connection modules, the third and fourth connection modules allow differences between propulsion assemblies, e.g. regarding the angular position of the input shafts, the number of input shafts, or the gear ratios. Thereby an increased flexibility is provided for the design and installation of marine vessel propulsion systems.

The second module interface may comprise an end of a second propulsion unit input shaft drivingly connected to the driveshaft. The third module output shaft may be connectable to the second propulsion unit input shaft. The fourth module output shaft may be connectable to the second propulsion unit input shaft.

The module interface may comprise an end of a propulsion unit input shaft drivingly connected to the driveshaft. The first module output shaft may be connectable to the propulsion unit input shaft. The second module output shaft may be connectable to the propulsion unit input shaft.

The module output shaft facilitates standardizing the module to propulsion unit interfaces. For example, the positions, in relation to the propulsion unit, of the output shafts of the different connection modules, when mounted to the propulsion unit, may be identical.

Preferably, the input shafts of the first and third connection modules are drivingly connected to the respective output shafts of the connection modules via respective gear arrangements, which are adapted so that a gear ratio between the input shaft and the output shaft of the first connection module is different from a gear ratio between the input shaft and the output shaft of the third connection module. Thus, the first and third connection modules may provide different gear ratios.

Thereby, power supply units having different output rotational speed ranges can be connected to the first and second module interfaces. Thereby, the flexibility allowed by embodiments of the invention is further increased.

In some embodiments, the output shaft of the first connection module extends in an angle to the driveshaft which is larger than zero degrees, and smaller than 180 degrees, wherein a first input shaft of the one or more input shafts of the first connection module is adapted to be connected to an output shaft of a first power supply unit, wherein the first input shaft of the first connection module extends in an angle to the output shaft of the first connection module, which is larger than zero degrees, and smaller than 180 degrees.

The angle in which the connection module output shaft extends to the driveshaft may be for example substantially 90 degrees. The first connection module output shaft may be connected to the driveshaft via a bevelled gear and optionally one or more intermediate shaft, such an input shaft of the propulsion unit.

The angle in which the first connection module input shaft extends to the first connection module output shaft may be for example substantially 90 degrees. The first connection module input shaft may be connected to the first connection module output shaft via a bevelled gear.

Thereby advantageous changes of the direction of the power delivered from the power supply unit output shaft to the driveshaft are provided.

In some embodiments, the first connection module further comprises a second input shaft drivingly connected to the output shaft of the module, and adapted to be connected to an output shaft of a second power supply unit.

Thereby, two power supply units may be connected to the first connection module. The first connection module input shafts may be connected to the module output shaft via a bevelled gear. The first connection module input shafts may extend perpendicularly to the output shaft and in opposite directions.

In some embodiments, the first connection module is a primary connection module, wherein the first propulsion assembly comprises a secondary connection module comprising an output shaft which is drivingly connected to the driveshaft, wherein the output shaft of the secondary connection module extends in an angle to the driveshaft which is larger than zero degrees, and smaller than 180 degrees, wherein the secondary connection module further comprises an input shaft drivingly connected to the output shaft of the secondary connection module and adapted to be connected to an output shaft of a third power supply unit.

In some embodiments, the input shaft of the secondary connection module is a first input shaft, wherein the secondary connection module further comprises a second input shaft drivingly connected to the output shaft of the secondary connection module, and adapted to be connected to an output shaft of a fourth power supply unit.

Thereby, the power supplied to the propulsion unit may be further increased, and/or divided between further power propulsion units. For example, the power supply units may be four electrical motors, four internal combustion engines, or a mix of such motors and engines, each connected to a respective connection module input shaft.

In some embodiments, the input shafts of the connection modules are drivingly connected to the output shafts of the modules via respective gear arrangements, which are adapted so that a gear ratio between the input shaft and the output shaft of the primary connection module is different from a gear ratio between the input shaft and the output shaft of the secondary connection module. As suggested above, thereby power supply units having different output rotational speed ranges can be connected to the primary and secondary connection modules.

In some embodiments, the primary and secondary connection modules comprise respective reversing gears for reversing the rotational direction of the driveshaft in relation to the rotational directions of the output shafts of the power supply units. By providing reversing function in the connection modules, the propulsion unit, to which the modules are connected, may be simplified.

In some embodiments, the one or more connection modules may comprise respective clutches, adapted to engage or disengage the power supply units. The respective clutch may be of a type that is capable of providing a slip function.

In some embodiments, freewheels are provided between the connection module input shafts and the power supply unit output shafts, or between input and output shafts of the connection modules.

In some embodiments, one or more of the connection modules comprise power take-off and power intake (PTO/PTI) interfaces, for example for providing power to an auxiliary unit in the vessel.

An aspect of the invention also provides a propulsion assembly for a marine vessel, comprising a propulsion unit comprising a driveshaft adapted to be drivingly connected to one or more thrust generating devices adapted to generate a thrust by acting on water carrying the marine vessel, wherein the propulsion assembly comprises a first connection module selected from a set of parts according to any one of claim 1-11.

The object is also reached with a method of designing a propulsion system for a marine vessel, comprising determining a position in the marine vessel of a propulsion unit of a set of parts according to any one of claims 1-11, determining a position in the marine vessel of a power supply unit for the propulsion unit, and selecting, in dependence on the determined propulsion unit and power supply unit positions, for connecting the propulsion unit and the power supply unit, a first connection module or a second connection module of a set of parts according to any one of claims 1-11.

The propulsion unit and power supply unit position determinations may be dependent on determining a set of requirements for the propulsion system, which requirements may include power requirements, and requirements due to space limitations in the vessel.

Similarly to what has been suggested above, the first and second connection modules allow an increased flexibility is provided for the design and installation of marine vessel propulsion systems.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION OF EXAMPLE EMBODIMENTS OF THE INVENTION

Figure 1:
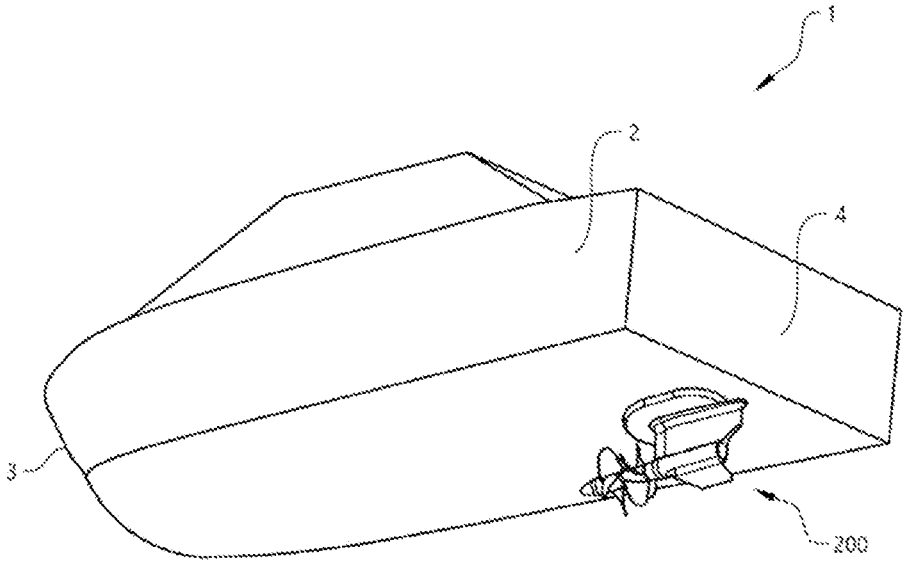
FIG. 1 is a perspective view from below of a marine vessel comprising a propulsion system comprising a propulsion assembly according an embodiment of the invention.

FIG. 1 shows a marine vessel 1 in the form of a power boat. It should be noted that the invention is equally applicable to other types of marine vessels, such as ships or sailing yachts. The marine vessel 1 comprises a hull 2 having a bow 3 and a stern 4. The marine vessel 1 further comprises a propulsion system with a propulsion unit 200 according to an embodiment of the invention. In this example, the propulsion unit is a pod drive.

Figure 2:
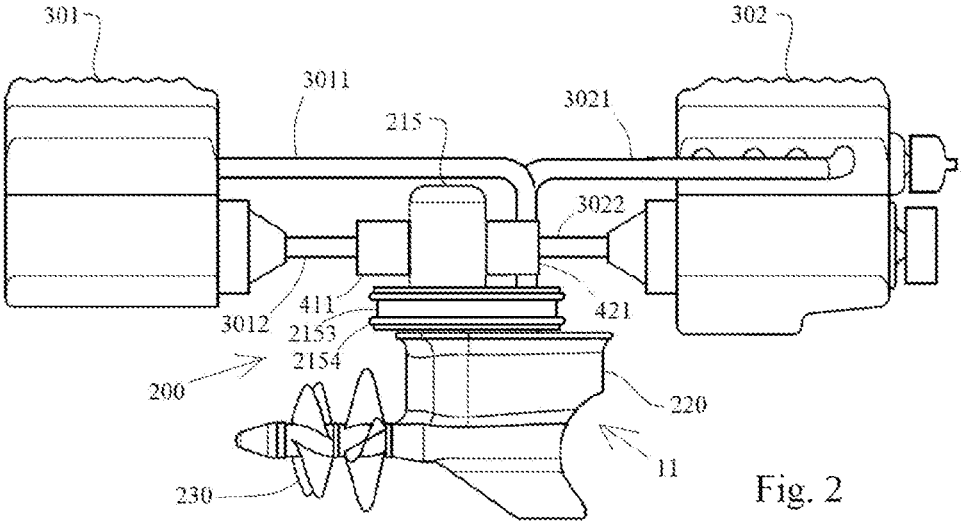
FIG. 2 is a side view of the propulsion system of the marine vessel in FIG. 1.

Reference is made also to FIG. 2. The propulsion unit 200 comprises a stationary part 215 adapted to be mounted to the hull of the marine vessel. The stationary part comprises an intermediate housing 2153. The intermediate housing is adapted to be mounted to the hull, in a cutout of the hull. The cutout is below the waterline of the hull. Sealing rings 2154 are provided to seal between the intermediate housing and the hull.

The propulsion unit also comprises a movable part 220. The movable part is adapted to be immerged in water carrying the marine vessel. The propulsion system comprises primary and secondary power supply units in the form of internal combustion engines 301, 302, adapted to deliver mechanical power to the propulsion unit 200. In this embodiment, the engines are, in relation to a direction of straight forward travel of the marine vessel, located forward and behind the propulsion unit 200.

An output shaft 3012 of the primary power supply unit 301 is connected to the propulsion unit 200 via a primary connection module 411, as described closer below. An output shaft 3022 of the secondary power supply unit 302 is connected to the propulsion unit 200 via a secondary connection module 421, as described closer below. The primary and secondary connection modules are mounted on opposite sides of the propulsion unit 200.

The movable part comprises two thrust generating devices in the form of propellers 230, adapted to transform the received power into a thrust by acting on the water carrying the marine vessel. The propellers are coaxially arranged, and counter-rotating. However, the invention is equally applicable to propulsion units with a single propeller. The propellers are in this embodiment pulling propellers. However, the invention is equally applicable to propulsion units with one or more pushing propellers. It should also be noted that the invention is equally applicable to other types of propulsion units, such as stern drives, or water jet devices.

Figure 3:
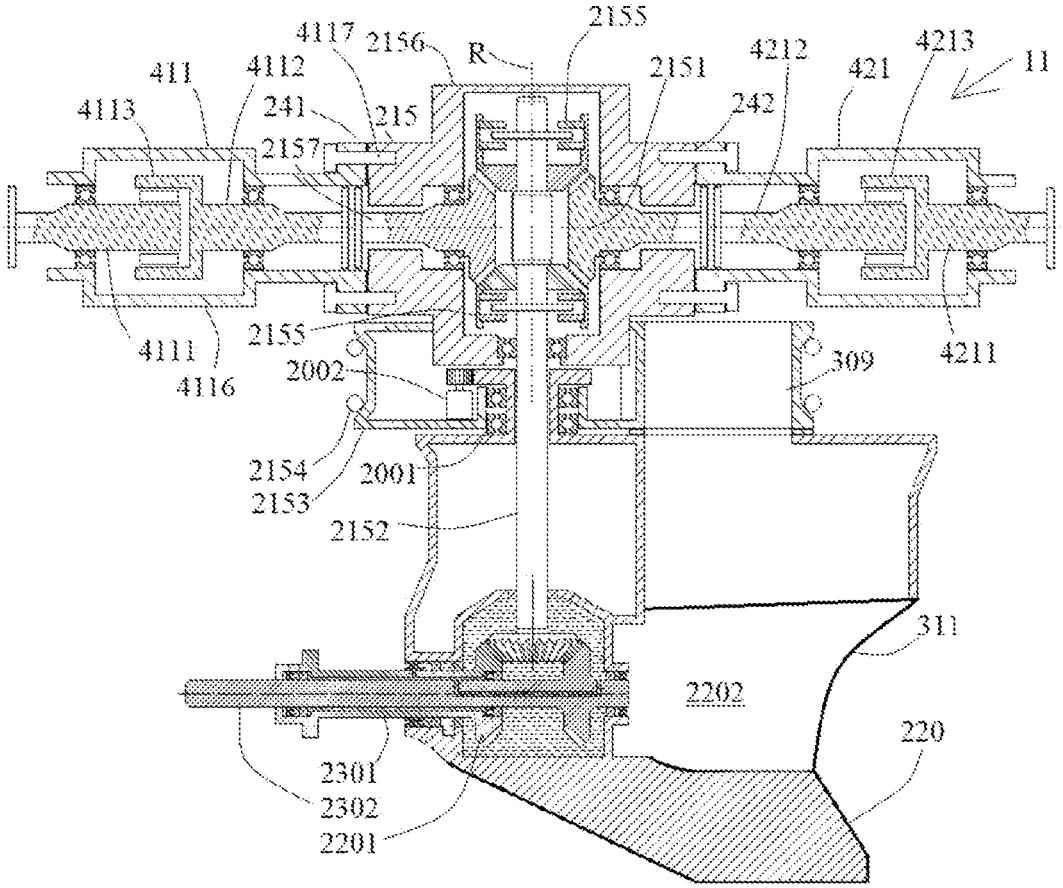
FIG. 3 is a cross-sectional view of the propulsion assembly of the marine vessel in FIG. 1, the section coinciding with propeller axes and driveshafts of the propulsion assembly.

Reference is made also to FIG. 3. The movable part 220 is rotatable in relation to the stationary part 215 around a rotation axis R for adjusting the direction of the thrust in relation to the hull. For this, the propulsion unit comprises a rotation bearing arrangement 2001. The movable part is arranged to be rotated by means of one or more rotation actuators, e.g. in the form of one or more electrical motors 2002 and a cog engagement. The one or more rotation actuators may be controllable by an electronic control unit (not shown) in dependence on signals from a user maneuvering device such as a steering wheel (not shown). The control unit may comprise computing means such as a CPU or other processing device, and storing means such as a semiconductor storage section, e.g., a RAM or a ROM, or such a storage device as a hard disk or a flash memory.

The stationary part 215 comprises an input transmission 2151 for transferring power from the connection modules 411, 421, to a driveshaft 2152 of the propulsion unit, as described below. The power supply units 301, 302 may be disengageably connectable to the input transmission, e.g. by means of respective disc clutches, such as e.g. dry or wet plate clutches, centrifugal clutches, overrunning clutches, and/or electromagnetic clutches, (not shown). The input transmission is housed in a transmission housing 2156.

The input transmission 2151 may be arranged to reverse the rotational direction of the driveshaft 2152. The input transmission 2151 may be provided as described in WO2020083494A1, incorporated herein by reference. Such a transmission has two output gears and two clutches 2155 for reversing the driveshaft rotational direction 2152. However, it should be noted that the input transmission may be provided in any suitable way.

In use, the driveshaft 2152 may be substantially perpendicular to a local extension of the hull where the propulsion unit is installed. The driveshaft 2152 extends from the stationary part 215 to into the movable part 220. The driveshaft 2152 is coaxial with the rotation axis R. The movable part 220 comprises an output transmission 2201 arranged to transfer power from the driveshaft 2152 to two final driveshafts 2301, 2302, each arranged to transfer respective portions of the power to a respective of the thrust generating devices 230. The driveshaft preferably comprises two shaft parts, connected with a spline sleeve (not shown).

The propulsion unit is adapted to receive exhaust gases from the engines 301, 302, and the movable part 220 is adapted to release the exhaust gases into the water. For receiving the exhaust gases from the engines, the propulsion unit comprises two unit inlets. Each unit inlet is adapted to receive exhaust gases from a respective of the engines 301, 302. The delivery of the exhaust gases from the engines, e.g. from exhaust treatment devices thereof, may be done by respective exhaust pipes 3011, 3021, (FIG. 2). As exemplified in FIG. 3, the stationary part 215 comprises a stationary exhaust conduit 309 extending from the unit inlets to the movable part 220. The movable part 220 comprises a movable exhaust conduit, and a unit outlet 311 for releasing the exhaust gases into the water.

The primary connection module 411 comprises an input shaft 4111 connected to the output shaft 3012 (FIG. 2) of the primary power supply unit 301. The primary connection module 411 is mounted to a first module interface 241 of the propulsion unit 200. The primary connection module 411 comprises a housing 4116. The housing 4116 of the primary connection module 411 is mounted to the transmission housing 2156 by means of a plurality of first fastening elements 4117, in this example in the form of bolts. Thereby, a housing of the primary connection module 411 is bolted to a housing of the propulsion unit. The primary connection module 411 comprises an output shaft 4112. The output shaft is connected to an input shaft 2157 of the input transmission 2151, in this example by means of a bolted flange connection. Alternatively, the primary connection module output shaft 4112 can be connected to the input shaft 2157 in another way, e.g. by a spline connection. Thereby, the output shaft 4112 of the primary connection module extends in an angle to the driveshaft 2152 of substantially 90 degrees. The primary connection module output shaft 4112 is connected to the primary connection module input shaft 4111 via a freewheel 4113. Thereby, the input shaft 4111 is drivingly connected to the driveshaft 2152. The primary connection module input shaft 4111 is coaxial with the primary connection module output shaft 4112.

Similarly, the secondary connection module 421 comprises an input shaft 4211 connected to the output shaft 3022 (FIG. 2) of the secondary power supply unit 302. The secondary connection module 421 is mounted to a second module interface 242 of the propulsion unit 200. Thereby, a housing of the secondary connection module 421 is bolted to a housing of the propulsion unit. The secondary connection module 421 comprises an output shaft 4212. The output shaft is connected to an input shaft of the input transmission 2151, e.g. by means of a bolted flange connection, or a spline connection. Thereby, the output shaft 4212 of the secondary connection module extends in an angle to the driveshaft 2152 of substantially 90 degrees. The secondary connection module output shaft 4212 is connected to the secondary connection module input shaft 4211 via a freewheel 4213. Thereby, the input shaft 4211 is drivingly connected to the driveshaft 2152.

In some embodiments, a connection module may have a single shaft, which forms the input shaft as well as the output shaft of the connection module.

The propulsion unit 200, the primary connection module 411, and the secondary connection module 421 form a first propulsion assembly 11.

Figure 4:
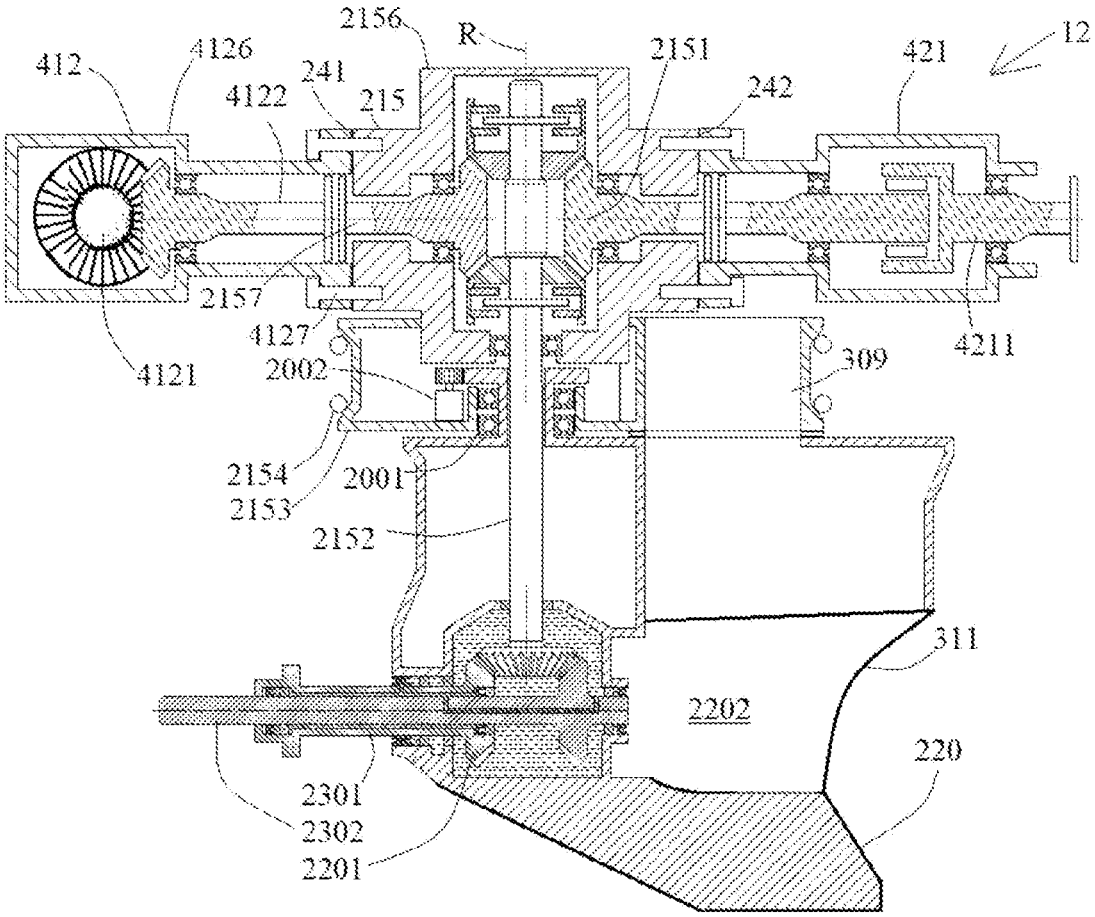
FIG. 4 is a cross-sectional view similar to the one in FIG. 3, of a propulsion assembly which is altered in relation to the one in FIG. 3.

Reference is made also to FIG. 4. What has been described above as a primary connection module 411 is herein also referred to as a first connection module. What has been described above as a secondary connection module 421 is herein also referred to as a third connection module.

As detailed below, the first connection module 411 may be exchanged for a second connection module. Thereby, the propulsion unit 200, the second connection module 412, and the third connection module 421 form a second propulsion assembly 12.

The propulsion unit 200, the first connection module 411, the second connection module 412, and the third connection module 421 form what is herein referred to as a set of parts for marine vessel propulsion assemblies.

The second connection module 412 is mounted to the first module interface 241 of the propulsion unit 200. The second connection module 412 comprises a housing 4126. The housing 4126 of the second connection module 412 is mounted to the transmission housing 2156 by means of a plurality of second fastening elements 4127, in this example in the form of bolts. The second connection module 412 comprises an input shaft 4121 connected to the output shaft 3012 of the primary power supply unit, and an output shaft 4122 of the second connection module 412 is connected to the input shaft 2157 of the input transmission 2151, by means of a bolted flange connection.

The position, in relation to the propulsion unit, of the output shaft 4122 of the second connection module 412, when the second connection module 412 is mounted to the propulsion unit, is the same as the position, in relation to the propulsion unit, of the output shaft 4112 of the first, or primary, connection module 411, when the first connection module 411 is mounted to the propulsion unit. Also, the positions, in relation to the propulsion unit 200, of the second fastening devices 4127, when the second connection module 412 is mounted to the propulsion unit, are the same as the positions of the first fastening devices 4117, when the first connection module 411 is mounted to the propulsion unit.

The second connection module output shaft 4122 is connected to the second connection module input shaft 4121 via a bevelled gear. Thereby, the second connection module input shaft 4121 extends in an angle to the second connection module output shaft 4122 of substantially 90 degrees. Thereby, with the second propulsion assembly 12, the primary power supply unit is oriented in an angle of 90 degrees to the orientation that the primary power supply unit has with the first propulsion assembly 11. Thus, the angular position, in relation to the propulsion unit 200, of the input shaft 4111 of the first connection module 411, differs from the angular position, in relation to the propulsion unit, of the input shaft 4121 of the second connection module 412.

Thereby, first and second propulsion assemblies 11, 12 as shown in FIG. 3 and FIG. 4 provide for positioning the power supply units in different ways, in dependence on different space availabilities in the marine vessels in which they are installed. With the second propulsion assembly 12, one of the power supply units is, in relation to a direction of straight forward travel of the marine vessel, located forward or behind the propulsion unit 200. The other of the power supply units is located laterally displaced in relation to the propulsion unit 200.

Figure 5:
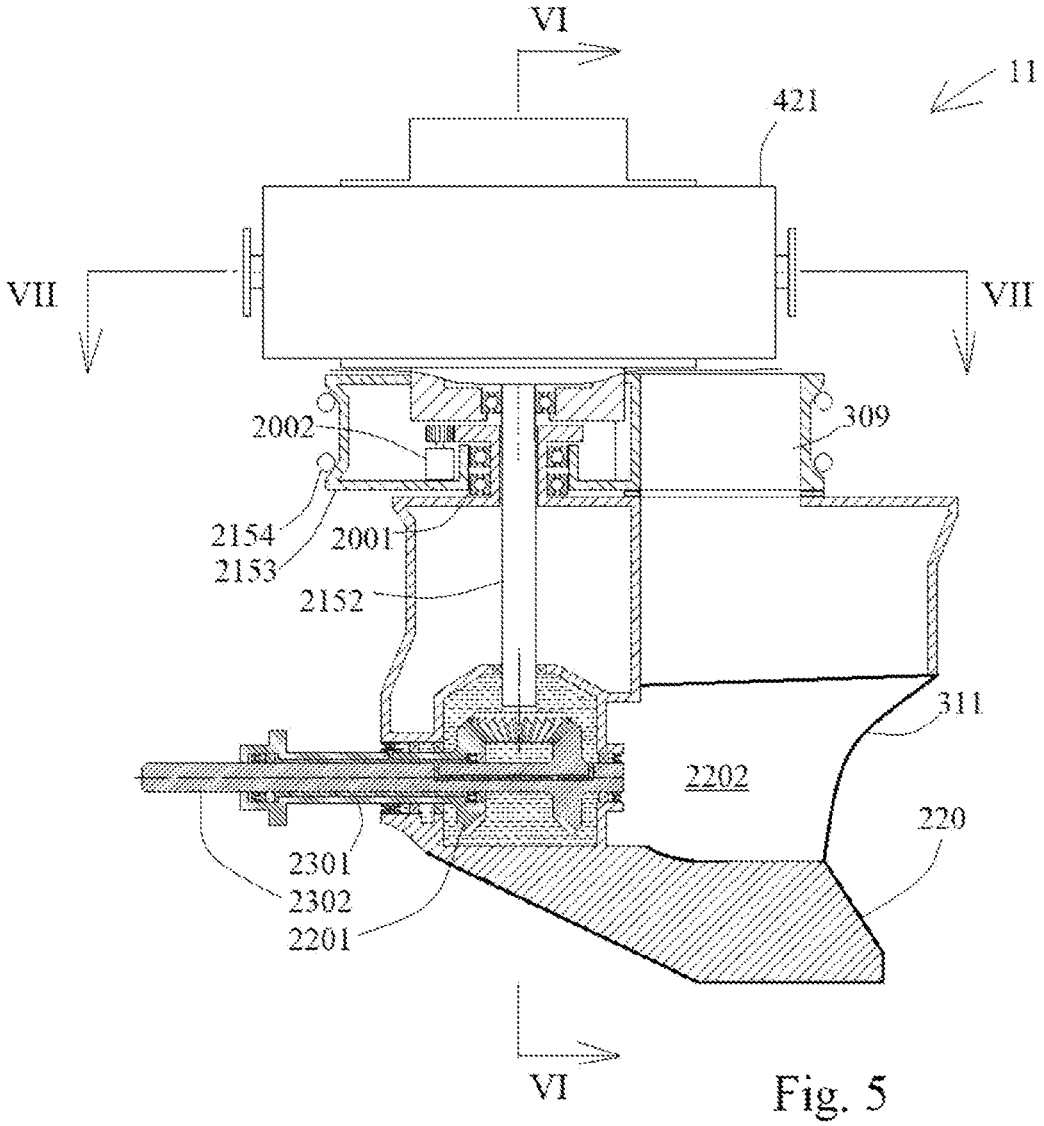
FIG. 5 is a partially sectioned view of a propulsion assembly according to another embodiment of the invention, the section coinciding with propeller axes and driveshafts of the propulsion assembly.
Figure 6:
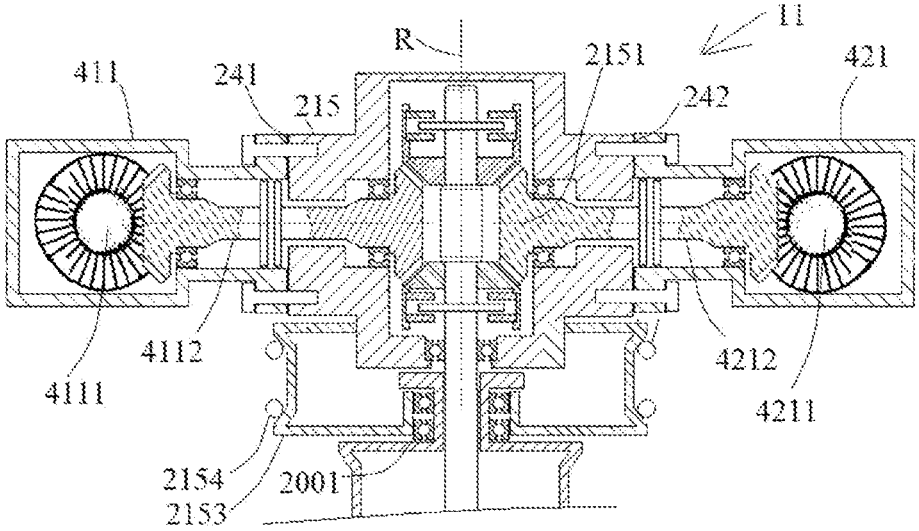
FIG. 6 is a cross-sectional view of the propulsion assembly in FIG. 5, with the section oriented as indicated with the arrows VI-VI in FIG. 5.
Figure 7:
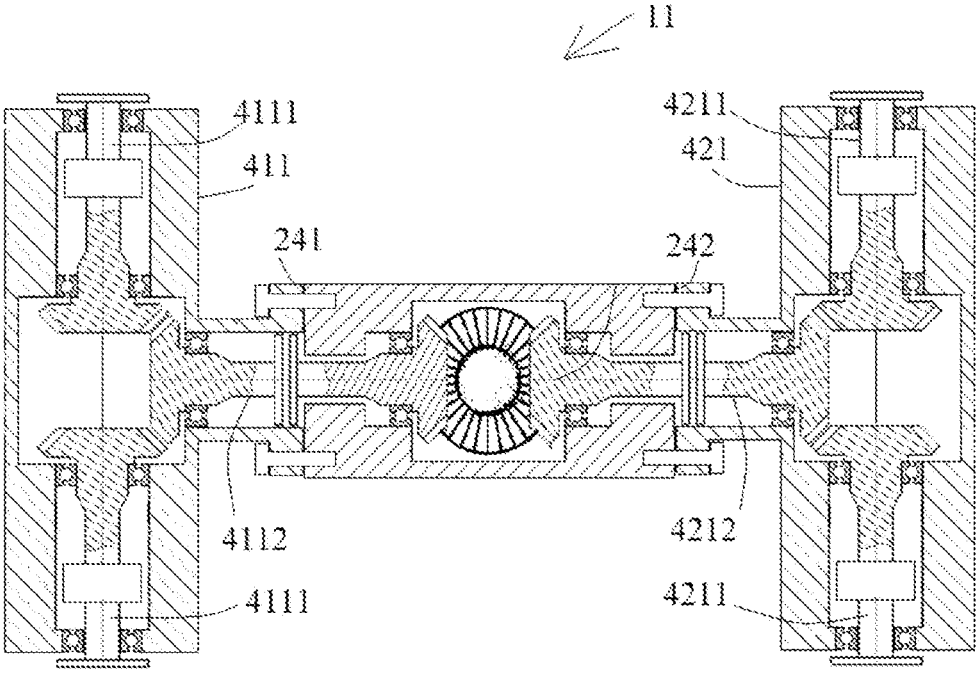
FIG. 7 is a cross-sectional view of the propulsion assembly in FIG. 5, with the section oriented as indicated with the arrows VII-VII in FIG. 5.

Reference is made to FIG. 5-FIG. 7, showing a propulsion assembly which is similar to the propulsion assembly shown in FIG. 3, but with differences as detailed here:

The primary connection module 411 comprises two input shafts 4111 connected to a respective output shaft of a respective power supply unit. The primary connection module output shaft 4112 is connected to the primary connection module input shafts 4111 via a bevelled gear. Thereby, the primary connection module input shafts 4111 extend in an angle to the primary connection module input shafts 4111 of substantially 90 degrees. The primary connection module input shafts 4111 are coaxial to each other. Thus, the power supply units connected to the input shafts are located on opposite sides of the primary connection module 411.

Similarly, the secondary connection module 421 comprises two input shafts 4211 connected to a respective output shaft of a respective power supply unit. The secondary connection module output shaft 4212 is connected to the secondary connection module input shafts 4211 via a bevelled gear. Thereby, the secondary connection module input shafts 4211 extend in an angle to the secondary connection module input shafts 4211 of substantially 90 degrees. The secondary connection module input shafts 4211 are coaxial to each other. Thus, the power supply units connected to the input shafts are located on opposite sides of the secondary connection module 421.

The propulsion unit 200, the primary connection module 411, and the secondary connection module 421 form a first propulsion assembly 11. With the first propulsion assembly 11, four power supply units can be arranged to deliver power to the propulsion unit 200. Thereby, two of the power supply units may be, in relation to a direction of straight forward travel of the marine vessel, located forward of the propulsion unit 200, and the other two power supply units may be located behind the propulsion unit 200.

Figure 8:
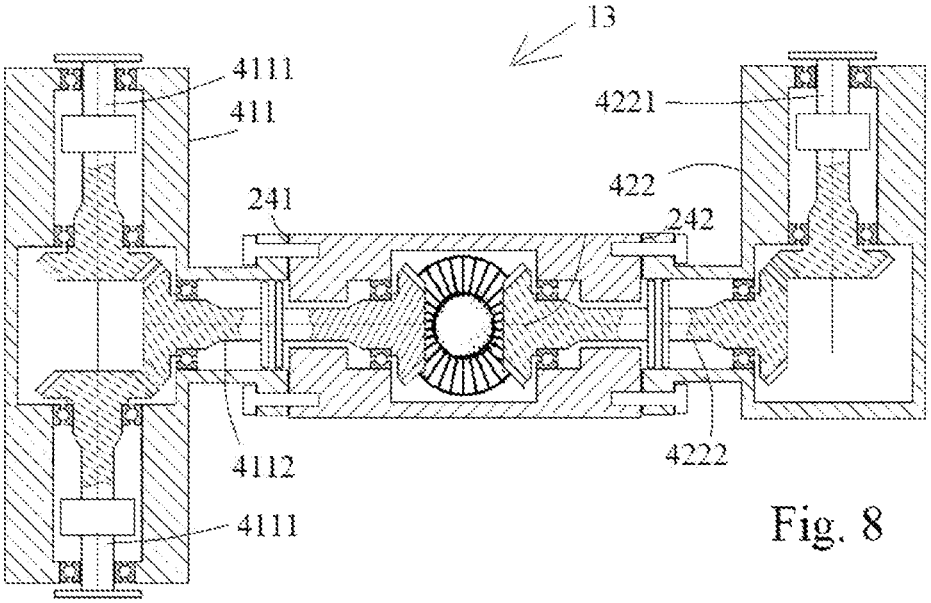
FIG. 8 is a cross-sectional view similar to the one in FIG. 7, of a propulsion assembly which is altered in relation to the one in FIG. 7.

Reference is made also to FIG. 8. What has been described with reference to FIG. 5-FIG. 7 as a primary connection module 411 is herein also referred to as a first connection module. What has been described with reference to FIG. 5-FIG. 7 as a secondary connection module 421 is herein also referred to as a third connection module.

As detailed below, the third connection module 421 may be exchanged for a fourth connection module. Thereby, the propulsion unit 200, the first connection module 411, and the fourth connection module 422 form a third propulsion assembly 13.

The fourth connection module 422 is mounted to the second module interface 242 of the propulsion unit 200. The fourth connection module 422 is similar to the third connection module, except for the following difference: The fourth connection module 422 has only one input shaft 4221. Thereby, the number of input shafts 4211 of the third connection module differs from the number of input shafts 4221 of the fourth connection module. With the third propulsion assembly 13, two of the power supply units may be, in relation to a direction of straight forward travel of the marine vessel, located forward of the propulsion unit 200, and the remaining power supply unit may be located behind the propulsion unit 200, or vice versa.

Thereby, first and third propulsion assemblies 11, 13 as shown in FIG. 5-FIG. 8 provide for connecting different numbers of power supply units to the propulsion unit, in dependence on different space availabilities, and/or power requirements, in the marine vessels in which they are installed.

Thus, embodiments of the invention provide a large degree of flexibility for installations of propulsion systems in marine vessels. In particular, by means of the connection modules, a single design of a propulsion unit can be used with a variety of configurations of one or more power supply units.

Figure 9A:
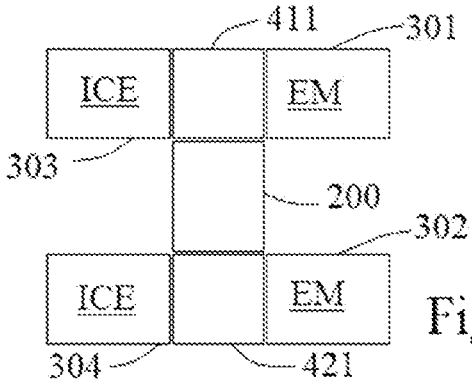
FIG. 9*a*-FIG. 9*c* depict examples of configurations of propulsion systems allowed with embodiments of the invention.
Figure 9B:
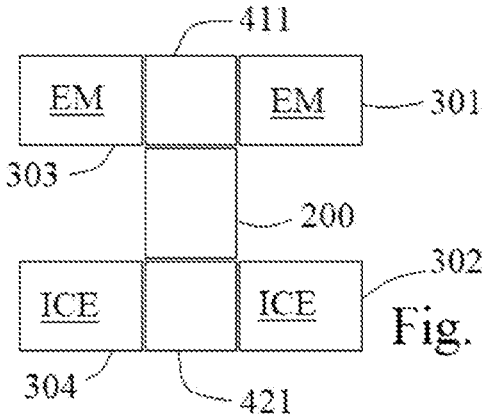
Figure 9C:
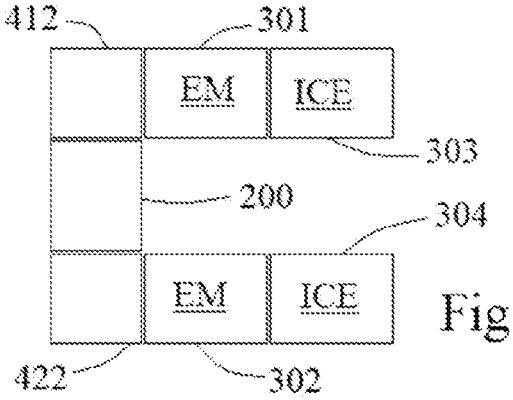

Reference is made to FIG. 9*a*-FIG. 9*c*, depicting examples of configurations of propulsion systems allowed with embodiments of the invention.

In FIG. 9*a*, a first power supply unit 301, in the form of an electric motor, is drivingly connected to a propulsion unit 200 via a primary connection module 411. A second power supply unit 303, in the form of an internal combustion engine, is drivingly connected to the propulsion unit 200 via the primary connection module 411. The first and second power supply units 301, 303 are located on opposite sides of the primary connection module 411.

A third power supply unit 302, in the form of an electric motor, is drivingly connected to the propulsion unit 200 via a secondary connection module 421. A fourth power supply unit 304, in the form of an internal combustion engine, is drivingly connected to the propulsion unit 200 via the secondary connection module 421. The third and fourth power supply units 302, 304 are located on opposite sides of the secondary connection module 421.

The configuration in FIG. 9*b* is similar to the configuration in FIG. 9*a*, except for the following difference: A second power supply unit 303, in the form of an electric motor, is drivingly connected to the propulsion unit 200 via the primary connection module 411. A third power supply unit 302, in the form of an internal combustion engine, is drivingly connected to the propulsion unit 200 via the secondary connection module 421.

More generally, one, two or more electric motors may be drivingly connected to the propulsion unit 200 via the primary connection module 411, and one, two or more internal combustion engines may be drivingly connected to the propulsion unit 200 via the secondary connection module 421. Thereby, the primary and secondary connection modules may provide different gear ratios. Each gear ratio may be adapted to a respective rotation speed interval of the engine(s) and the motor(s).

The configuration in FIG. 9*c* is similar to the configuration in FIG. 9*a*, except for the following difference: A second power supply unit 303, in the form of an internal combustion engine, is drivingly connected to the first power supply unit 301. A fourth power supply unit 304, in the form of an internal combustion engine, is drivingly connected to the third power supply unit 302.

It should be noted that in embodiments of the invention, a marine vessel could be provided with two or more propulsion units. Thereby, each propulsion unit could be arranged to be driven by one or more power supply units, via one or more connection modules, in any suitable configuration, e.g. as described above with reference to FIG. 3-FIG. 9*c*.

Figure 10:
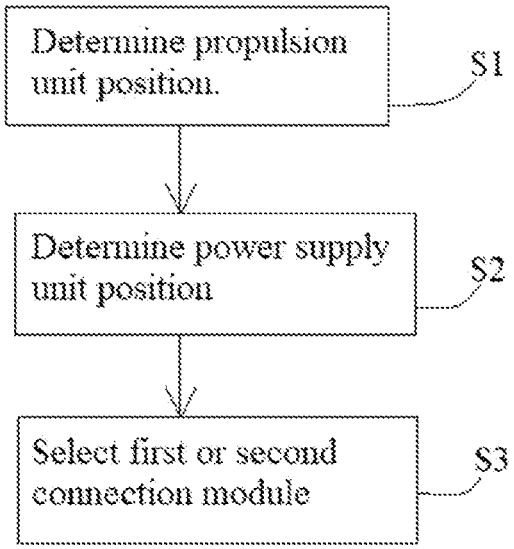
FIG. 10 is a flow diagram depicting steps in a method of designing a propulsion system for a marine vessel, according to an embodiment of the invention.
Figure 11A:
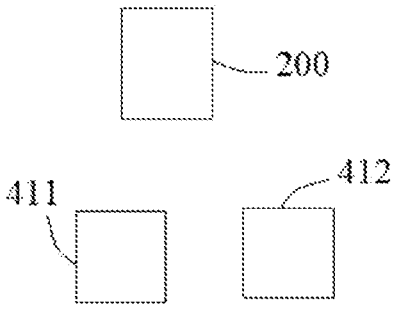
FIG. 11*a*-FIG. 11*c* depict a set of parts and alternative configurations of propulsion systems as results of selections in the method in FIG. 10.
Figure 11B:
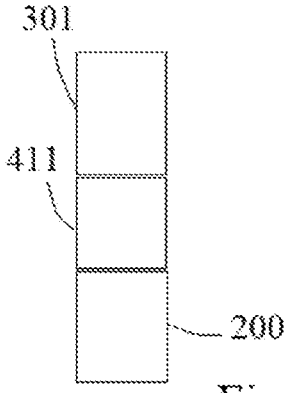
Figure 11C:
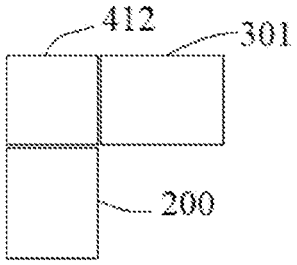

With reference is made to FIG. 10-FIG. 11*c*, a method of designing a propulsion system for a marine vessel, according to an embodiment of the invention will be described. The method makes use of a set of parts 200, 411, 412 as depicted in FIG. 11*a*. In this example, only three parts are shown, but it is understood that embodiments of the invention are applicable to large sets of parts, e.g. held in storage at suppliers of marine propulsion assemblies.

The method comprises determining S1 a position in the marine vessel of a propulsion unit 200. The method further comprises determining S2 a position in the marine vessel of a power supply unit 301 for the propulsion unit. The method further comprises selecting S3, in dependence on the determined propulsion unit and power supply unit positions, for connecting the propulsion unit and the power supply unit, a first connection module 411, e.g. as in FIG. 11*b*, or a second connection module 412, e.g. as in FIG. 11*c*.

Figure 12:
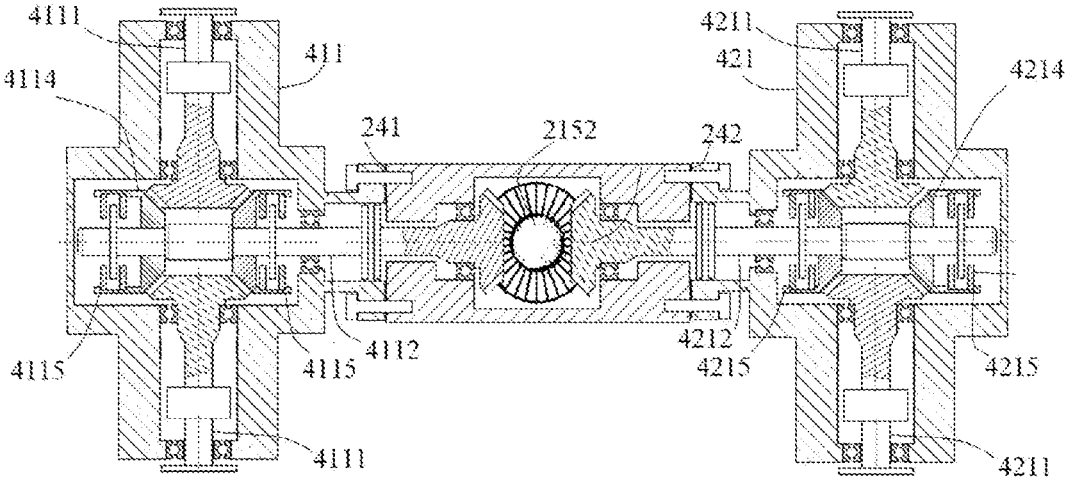
FIG. 12 is a cross-sectional view similar to the view of FIG. 7, of a propulsion assembly according to a further embodiment of the invention.

Various variations of embodiments of the invention are possible. For example, as depicted in FIG. 12, the primary and secondary connection modules 411, 421 may comprise respective reversing gears 4114, 4214 for reversing the rotational direction of the connection module output shafts 4112, 4212 in relation to the rotational directions of the connection module input shafts 4111, 4112. Thereby, the rotational direction of the driveshaft 2152 in relation to the rotational directions of the output shafts of the power supply units, connected to the connection module input shafts 4111, 4112, can be reversed.

The connection module reversing gears 4114, 4214 may comprise two output gears and two clutches 4115, 4215.

It should be noted that a propulsion assembly according to any embodiment of the invention, may be provided in a propulsion device, also including the one or more power supply units. Such a propulsion device may be arranged to be mounted outside of a hull of a marine vessel, similarly to an outboard engine.

It is to be understood that the present invention is not limited to the embodiments described above and illustrated in the drawings; rather, the skilled person will recognize that many changes and modifications may be made within the scope of the appended claims.

The invention claimed is:

1. A set of parts for marine vessel propulsion assemblies, the set of parts comprising a propulsion unit, wherein the propulsion unit comprises a driveshaft adapted to be drivingly connected to one or more thrust generating devices adapted to generate a thrust by acting on water carrying the marine vessel, wherein the set of parts further comprises a first connection module comprising one or more input shafts, the first connection module comprising an output shaft, wherein the first connection module is adapted to be mounted to a module interface of the propulsion unit, so that the one or more input shafts of the first connection module are drivingly connected to the driveshaft via the output shaft of the first connection module, whereby the propulsion unit and the first connection module form at least a portion of a first propulsion assembly, wherein the set of parts further comprises a second connection module comprising one or more input shafts, the second connection module comprising an output shaft, wherein the second connection module is adapted to be mounted to the module interface of the propulsion unit, so that the one or more input shafts of the second connection module are drivingly connected to the driveshaft via the output shaft of the second connection module, whereby the propulsion unit and the second connection module form at least a portion of a second propulsion assembly, wherein positions, in relation to the propulsion unit, of the output shafts of the first and second connection modules, when the first or second connection modules is mounted to the propulsion unit, are the same, wherein the first propulsion assembly differs from the second propulsion assembly in that the number of the one or more input shafts of the first connection module differs from the number of the one or more input shafts of the second connection module, and/or the first connection module provides a gear ratio between one or more of the one or more input shafts of the first connection module and the driveshaft, which is different from a gear ratio provided by the second connection module between one or more of the one or more input shafts of the second connection module and the driveshaft.

2. A set of parts according to claim 1, wherein the propulsion unit comprises a housing, wherein the first and second connection modules comprise respective housings, wherein the first and second connection modules being adapted to be mounted to the module interface of the propulsion unit comprises the housing of the first connection module being adapted to be connected to the housing of the propulsion unit by means of one or more first fastening devices, and the housing of the second connection module being adapted to be connected to the housing of the propulsion unit by means of one or more second fastening devices, wherein respective positions, in relation to the propulsion unit, of the first and second fastening devices, when the first or second connection modules is mounted to the propulsion unit, are the same.

3. A set of parts according to claim 1, wherein the propulsion unit comprises an input shaft, wherein the first and second connection modules being adapted to be mounted to the module interface comprises the output shafts of the first and second connection modules being adapted to be connected to the input shaft of the propulsion unit.

4. A set of parts according to claim 1, wherein the module interface of the propulsion unit is a first module interface, wherein the set of parts further comprises a third connection module comprising one or more input shafts, the third connection module comprising an output shaft, wherein the third connection module is adapted to be mounted to a second module interface of the propulsion unit so that the one or more input shafts of the third connection module are drivingly connected to the driveshaft via the output shaft of the third connection module, whereby the propulsion unit, the first connection module, and the third connection module form at least a portion of the first propulsion assembly.

5. A set of parts according to claim 4, wherein the set of parts further comprises a fourth connection module comprising one or more input shafts, the fourth connection module comprising an output shaft, wherein the fourth connection module is adapted to be mounted to the second module interface of the propulsion unit, so that the one or more input shafts of the fourth connection module are drivingly connected to the driveshaft via the output shaft of the fourth connection module, whereby the propulsion unit, the first connection module and the fourth connection module form at least a portion of a third propulsion assembly, wherein the positions, in relation to the propulsion unit, of the output shafts of the third and fourth connection modules, when the third or fourth connection modules are mounted to the propulsion unit, are the same, wherein the first propulsion assembly differs from the third propulsion assembly in that the position, in relation to the propulsion unit, of one or more of the one or more input shafts of the third connection module, for example the angular position thereof, differs from the position, in relation to the propulsion unit, of any of the one or more input shafts of the fourth connection module, and/or the number of the one or more input shafts of the third connection module differs from the number of the one or more input shafts of the fourth connection module, and/or the third connection module provides a gear ratio between one or more of the one or more input shafts of the third connection module and the driveshaft, which is different from a gear ratio provided by the fourth connection module between one or more of the one or more input shafts of the fourth connection module and the driveshaft.

6. A set of parts according to claim 4, wherein the input shafts of the first and third connection modules are drivingly connected to the respective output shafts of the connection modules via respective gear arrangements, which are adapted so that a gear ratio between the input shaft and the output shaft of the first connection module is different from a gear ratio between the input shaft and the output shaft of the third connection module.

7. A set of parts according to claim 1, wherein the output shaft of the first connection module extends in an angle to the driveshaft which is larger than zero degrees, and smaller than 180 degrees, wherein a first input shaft of the one or more input shafts of the first connection module is adapted to be connected to an output shaft of a first power supply unit, wherein the first input shaft of the first connection module extends in an angle to the output shaft of the first connection module, which is larger than zero degrees, and smaller than 180 degrees.

8. A set of parts according to claim 7, wherein the first connection module further comprises a second input shaft drivingly connected to the output shaft of the module, and adapted to be connected to an output shaft of a second power supply unit.

9. A set of parts according to claim 7, wherein the first connection module is a primary connection module, wherein the first propulsion assembly comprises a secondary connection module comprising an output shaft which is drivingly connected to the driveshaft, wherein the output shaft of the secondary connection module extends in an angle to the driveshaft which is larger than zero degrees, and smaller than 180 degrees, wherein the secondary connection module further comprises an input shaft drivingly connected to the output shaft of the secondary connection module and adapted to be connected to an output shaft of a third power supply unit.

10. A set of parts according to claim 9, wherein the input shaft of the secondary connection module is a first input shaft, wherein the secondary connection module further comprises a second input shaft drivingly connected to the output shaft of the secondary connection module, and adapted to be connected to an output shaft of a fourth power supply unit.

11. A set of parts according to claim 9, wherein the primary and secondary connection modules comprise respective reversing gears for reversing the rotational direction of the driveshaft in relation to the rotational directions of the output shafts of the power supply units.

12. A propulsion assembly for a marine vessel, comprising a propulsion unit comprising a driveshaft adapted to be drivingly connected to one or more thrust generating devices adapted to generate a thrust by acting on water carrying the marine vessel, wherein the propulsion assembly comprises a first connection module selected from a set of parts according to claim 1.

13. A method of designing a propulsion system for a marine vessel, characterized by determining a position in the marine vessel of a propulsion unit of a set of parts according to claim 1, determining a position in the marine vessel of a power supply unit for the propulsion unit, and selecting, in dependence on the determined propulsion unit and power supply unit positions, for connecting the propulsion unit and the power supply unit, a first connection module or a second connection module of a set of parts.

* * * * *